US008578679B1

(12) United States Patent
Petricio Yaksic

(10) Patent No.: US 8,578,679 B1
(45) Date of Patent: Nov. 12, 2013

(54) SMOKESTACK ASSEMBLY

(76) Inventor: Davor Petricio Yaksic, Antofagasta (CL)

( * ) Notice: Subject to any disclaimer, the term of this patent is extended or adjusted under 35 U.S.C. 154(b) by 495 days.

(21) Appl. No.: 12/587,250

(22) Filed: Oct. 5, 2009

Related U.S. Application Data

(60) Provisional application No. 61/195,151, filed on Oct. 3, 2008.

(51) Int. Cl.
*E04B 1/00* (2006.01)
*E04G 21/00* (2006.01)
*E04G 23/00* (2006.01)

(52) U.S. Cl.
USPC ..... 52/745.17; 52/745.18; 52/745.19; 52/745.2

(58) Field of Classification Search
USPC ..... 52/123.1, 745.17, 745.18, 745.19, 52/745.2, 218, 745.04, 745.03; 110/184, 110/341; 126/500, 299 R, 300, 301, 302, 126/303, 299 C, 299 D, 299 E, 299 F, 307 R, 126/314, 315, 316, 317, 318, 319; 454/1; 264/31, 33; 425/63
See application file for complete search history.

(56) References Cited

U.S. PATENT DOCUMENTS 2,794,242 A * 6/1957 Evers et al. ..... 29/429
3,201,502 A * 8/1965 Pluckebaum ..... 264/34
3,239,990 A * 3/1966 Adler ..... 52/745.04
3,672,115 A * 6/1972 Abe et al. ..... 52/745.17
3,673,754 A * 7/1972 Murashige et al. ..... 52/745.17
3,828,513 A * 8/1974 Vanderklaauw ..... 52/745.04
4,050,214 A * 9/1977 Johnson ..... 52/745.18
5,528,877 A * 6/1996 Franklin ..... 52/745.13
6,301,841 B1 * 10/2001 Rhebergen et al. ..... 52/123.1
6,425,712 B1 * 7/2002 Vanderklaauw ..... 405/230
6,513,789 B2 * 2/2003 Kimura et al. ..... 254/89 H
7,269,949 B1 * 9/2007 Petricio Yaksic ..... 60/546
7,533,505 B2 * 5/2009 Henderson ..... 52/292
2009/0087311 A1 * 4/2009 Wyborn ..... 416/9

* cited by examiner

*Primary Examiner* — Andrew Triggs
(74) *Attorney, Agent, or Firm* — James Creighton Wray

(57) ABSTRACT

Smokestacks are built by constructing a reinforced pad, a reinforced base on the pad, placing a preconstructed smokestack welded base element and the reinforced base. A smokestack constructing machine is positioned on the base with cross beams extending above the welded base. A preassembled top section is placed on the beams. In a lower work area, jacks connected to lower fixtures on the top section raise the top section. Transition sections are inserted laterally on the beams, and the top section is lowered, attached and welded to the transition sections. The jacks are disconnected, lowered and reconnected. The top section is attached and welded to the lower section, which is raised to laterally insert another section. The raising, inserting, lowering, attaching, welding and raising steps are repeated until the smokestack is complete. Ladders and wind screws attachments are attached in an upper work area.

19 Claims, 9 Drawing Sheets

SMOKESTACK ASSEMBLY

This application claims the benefit of U.S. Provisional Application No. 61/195,151, filed Oct. 3, 2008, which is hereby incorporated by reference in its entirety.

BACKGROUND OF THE INVENTION

Tall smokestacks result in discharges of cool off streams with reduced noxious components and wider and greater diffusion and dispersion of fumes, vapors and gasses. Tall smokestacks are of particular use with carbon based conventional fuels in boilers and fluid bed boilers for production of steam in electric power generation.

Heretofore, building tall smokestacks has required tall scaffolding-like structures and tall cranes to lift structural materials several tens of meters into the air. Workers in the tall structures are exposed to environments of winds, rains and storms. Commuting vertically to and from the upper work platforms consumes time and expense. Lifting and lowering construction materials and workers consume power and add expense.

Needs exist for improved chimney and smokestack construction.

SUMMARY OF THE INVENTION

The invention builds smokestacks and chimneys upward from their bases. The new smokestack erection process and apparatus first construct a foundation of reinforced concrete. A smokestack base ring section is formed, welded and secured to the foundation. A chimney construction machine is built on the foundation. Plural spaced vertical double acting hydraulic cylinders are mounted in the chimney construction machine. Support beams are mounted on in the machine and on the lower ring section to support upper ring sections. A first top smokestack section is constructed. The first top section is inserted in the construction machine and placed and centered on the support beams.

Second and subsequent ring sections are constructed by bending plates and welding vertical seams.

Inward cantilevered arms from the hydraulic cylinders are connected to the first top section, and the first top section is raised with the hydraulic cylinders. While holding the first top section upward, a second ring section is laterally slid into the chimney construction machine. The second next upper ring is placed and centered on the support beams in the construction machine. The hydraulic cylinders lower the top smokestack section and juxtapose the second ring section and the first top smokestack section. The first top section and the second ring section are connected axially in fluid tight relationship. Flanges on the adjoining sections are used to lift and lower the sections.

The lifting arms are disconnected from the smokestack top section, lowered and connected to the second ring section. Then, the first top and second connected ring sections are lifted with the hydraulic cylinders. While holding the first top section and the second ring section upward, a third ring section is laterally inserted in the construction machine and centered on the support beams below the second ring section.

The hydraulic cylinders lower the top and second section and juxtapose the third ring section and the second ring section. The third and second sections are connected by bolting adjacent flanges together.

The lifting arms are disconnected from the upper sections, lowered by the cylinders and connected to the lower section, while the sections are supported on the support beams.

The third, second and first ring sections are lifted and held elevated with the hydraulic cylinders.

The construction steps continue, laterally inserting, lowering, vertically juxtaposing, axially connecting, lifting and holding sequentially subsequent ring sections. Finally the last and lower ring section is laterally inserted on the support beams. The hydraulic cylinders lower the above ring sections to the last ring section. The cylinders lower the above ring sections to the last ring section. The arms are disconnected from the above sections, lowered and connected to a lower section. The support beams are removed. Finally the joined ring sections are lowered and the last ring section is connected to the base ring section. Removing the chimney construction machine, the hydraulic cylinders and the support beams and readies the smokestack for use.

The support beams are disassembled and removed before juxtaposing and connecting the last ring section and the base ring section.

Placing the ring sections in the chimney construction machine includes laterally sliding successive ring sections on rails connected to or aligned with the support beams. The juxtaposing involves lowering the above ring sections into contact with the inserted ring section. Juxtaposing the upper ring sections may involve holding the upper ring sections and raising an inserted subsequent ring section to the next above ring section. The juxtaposing the upper ring sections and the inserted subsequent ring section may include lowering the above joined ring sections to the inserted subsequent ring section, which is centered on the support beams before connecting the inserted subsequent ring section to a next above ring.

The support beams are I beams. The connecting includes bolting or welding. The chimney construction machine has square planforms, The plural hydraulic cylinders include four double acting hydraulic cylinders. The chimney erection machine is about 10 meters high and about 7×7 meters in planform. The ring sections are about 2.44 meters high. Lifting about 2.5 meters is or sufficiently high to clear laterally inserted ring sections.

An example of a smokestack made according to the invention has a height of about 80 meters or more and a base diameter of about 6 meters.

The smokestack assembly is made by installing 8 m of the top part of the stack upon support beams on the lower segment, which is already bolted to the base. Then, by means of the new chimney construction machine, this top part is raised to insert a section of 2.44 m high and welding it to the upper part. That maneuver is repeated until getting the total height.

The new chimney construction machine is based on a type of rigid square platform, which is capable of moving in the direction perpendicular to its plane, being always the new position parallel to the previous one, even though it would be subject to a very high momentum of up to 1,500,000 kg×m for this application.

The basic principle is drawn in FIGS. 9 and 11 of my SYNCHRONIZING HYDRAULIC CYLINDERS U.S. Pat. No. 7,269,949, issued Sep. 18, 2007, which is incorporated herein by reference as if fully reproduced herein.

The rigid square platform will continue to move in the perpendicular direction parallel to the plan. Two dual action hydraulic cylinders in every corner oppose each other. The new chimney construction machine has sixteen chambers. Four drive up; four down. The eight remaining chambers, connected in a diagonal and opposite manner, are equalizer chambers, generating a momentum opposed to any attempt to take advantage of parallelism to the system. One equalizer chamber will act as a hydraulic pump and the other one, diagonally opposite, will act as a piston.

The new chimney construction machine has a tower with a mobile platform that is driven and stabilized by eight hydraulic cylinders located within the four pillars of the tower.

Other structures such as windmills, tall cooling towers or other towers may be built using the new invention.

These and further and other objects and features of the invention are apparent in the disclosure, which includes the above and ongoing written specification, with the drawings.

BRIEF DESCRIPTION

DETAILED DESCRIPTION OF THE DRAWINGS

Figure 1:
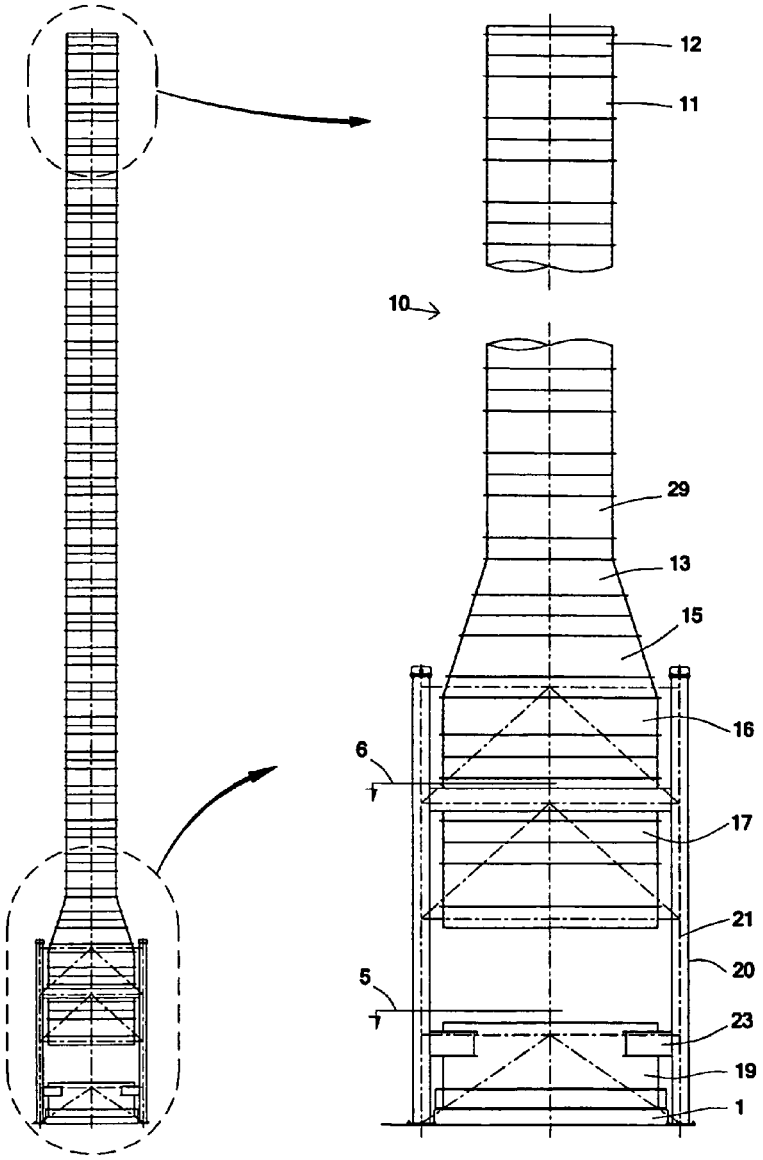
FIG. 1 is a schematic elevation of smokestack construction using a chimney erection machine.

Referring to the drawings, FIG. 1 shows a completed chimney or smokestack 10 being formed of upper ring sections 11, transition ring sections 13 and 15, and lower ring sections 16 and base ring sections 19.

To construct the chimney or smokestack 10, a reinforced foundation 1 is built first. Base ring 19 is bolted to foundation 1. A strong chimney erection machine 20 with vertical columns 21 is mounted on the foundation around base ring 19. Heavy I beams 23, shown also in FIG. 5, extend across diagonally opposite vertical columns 21 and are supported by the columns 21 and the base ring 19. The I beams 23 and rails leading to the supporting I beams are used to guide, center and support ring sections 11, 13, 15, 17 sequentially as they are inserted laterally and centered to build the chimney or smokestack 10.

Ring sections are constructed on site or off site from plates which are rolled into rings followed by joining and welding the vertical ends.

Figure 4:
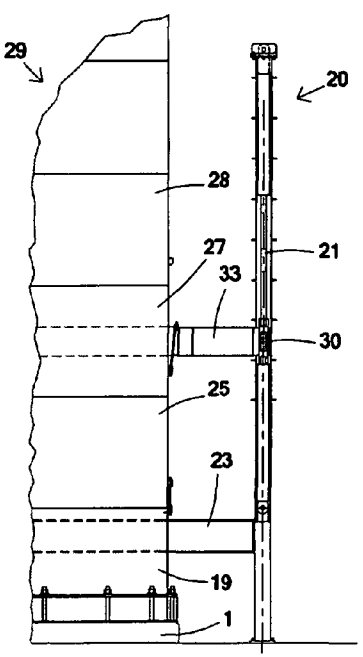
FIG. 4 is a schematic detail as shown in FIG. 3 after the upper rings have been lowered into contact with the inserted subsequent lower ring to connect the subsequent lower ring to the next above ring and the jacks have been lowered to engage the next lower ring.
Figure 3:
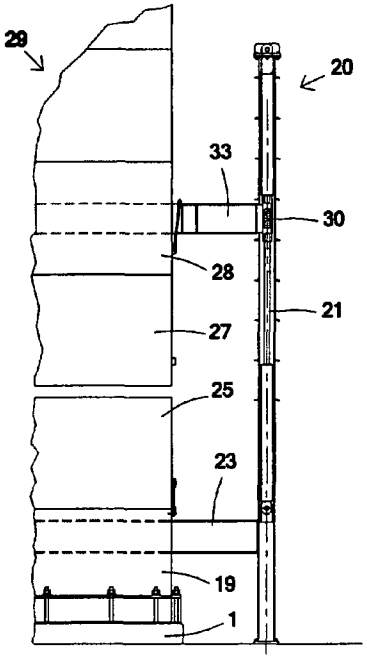
FIG. 3 is a schematic detail as shown in FIG. 2 after the subsequent lower ring is fully inserted.
Figure 2:
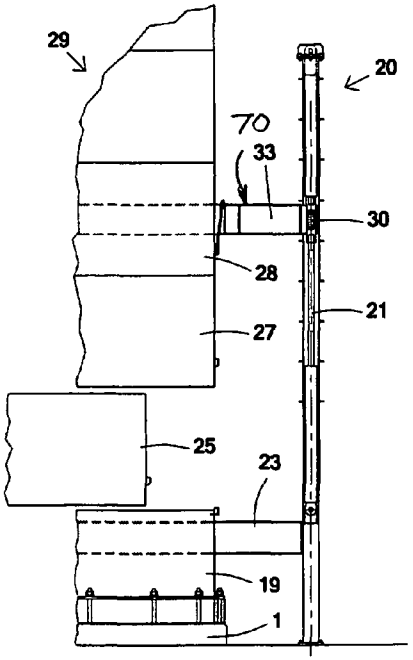
FIG. 2 is a schematic detail of one of the corner jacks lifting upper rings while a subsequent lower ring is being inserted.

FIGS. 2, 3 and 4 schematically show a specific lower ring section 25 being sequentially laterally inserted in FIG. 2, centered in FIG. 3 and joined and connected to the next above lower ring section 27 in the stack 29 of connected ring sections in FIG. 4.

Jacks 30 raise and lower the assembled stack 29 of ring sections. While ring section 25 is inserted and centered as shown in FIGS. 2 and 3, jacks 30 connected to ring section 28 above ring section 27 hold the assembled stack 29 of ring sections upward about 3" or less above the inserted ring section 25. Then, as shown in FIG. 4, the jacks 30 lower the stack 29 of assembled ring sections and ring section 27 onto the inserted ring section 25. The entire assembly is supported on the I beams 23. The inserted ring section 25 is bolted or welded to the next above ring section 27. Then the jacks 30 are disconnected from the above ring section 28, are lowered, and are connected to the ring section 27, as shown in FIG. 4.

The jacks 30 connected to ring section 27 or to the assembled stack of ring sections then are ready to lift the assembled stack 29 of ring sections, which includes newly connected ring section 25. The jacks may be connected to the lowermost ring section in the stack 29 or to the next above ring section, to both or to any above ring section.

The lateral inserting and centering of additional ring sections, the lowering of the stack of assembled ring sections, the juxtaposing of the lowermost ring section in the stack of ring sections to the newly inserted ring section, and the connecting of the newly inserted ring section to that lowermost ring section, are repeated until the chimney or smokestack is completed. After each lowering, the disconnection and lowering of the jacks and reconnecting the jacks to the next lower ring section, then raising the stack to make room for another laterally inserted ring section are continued until the entire stack is assembled. Thereupon, the support beams are removed.

To begin the construction, after inserting the top section 12, the jacks 30 are connected to the top ring 12 to lift the top section above the next laterally inserted ring.

Figure 5:
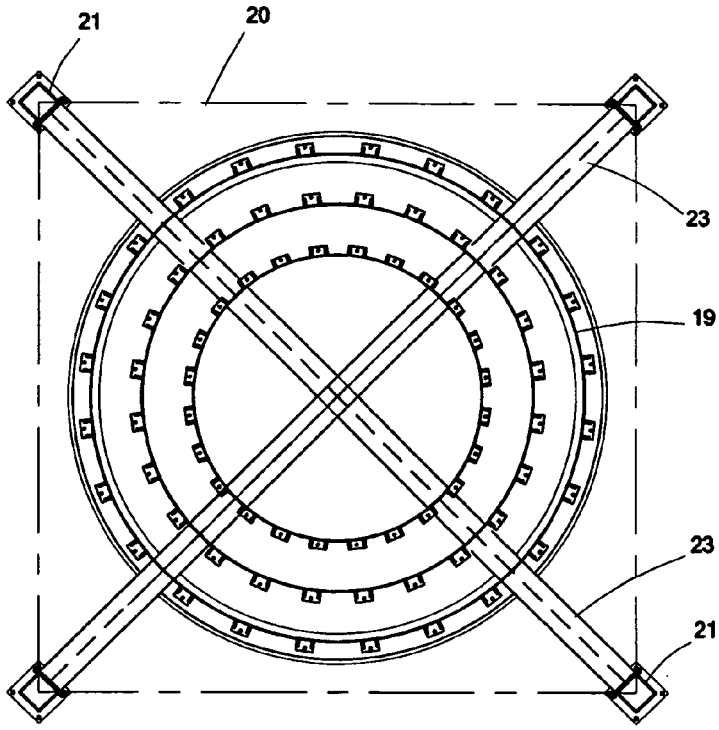
FIG. 5 is a horizontal cross sectional view of the erection machine taken along line 5 of FIG. 1 showing the foundation, the base ring, the support beams and showing the columns of the chimney erection machine in cross section.

FIG. 5 is a cross section of the machine 20 taken along line 5 of FIG. 1, showing the base ring 19, the columns 21 and the support beams 23. The base ring section 19 and the columns 21 hold the support beams 23. The columns 21 and base ring section 19 are mounted on the foundation.

Figure 6:
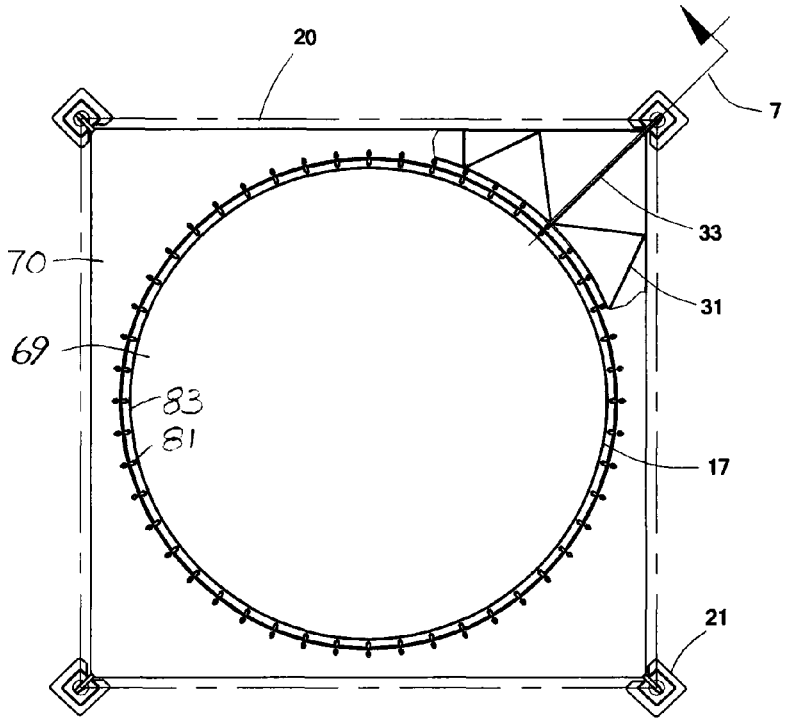
FIG. 6 is a horizontal cross sectional detail view of the erection machine taken along line 6 of FIG. 1 showing a jack connector extending inward from a double acting cylinder in one vertical column of the erection machine.

FIG. 6 is a cross section of the machine 20 taken along line 6 of FIG. 1, showing one of the jacks 30 which are connected to the ring sections such as a lower ring section 17. The jacks 30 have gripping and lifting structures 31, which include cantilevered beams 33 connected to double acting hydraulic cylinders. When the upper ring sections are being assembled, the structure 31 and cantilevered beams 33 use longer beams 33 and structures 31 to reach the smaller diameter ring sections. The platform 70 has a central opening 69 for receiving joined sections.

Figure 7:
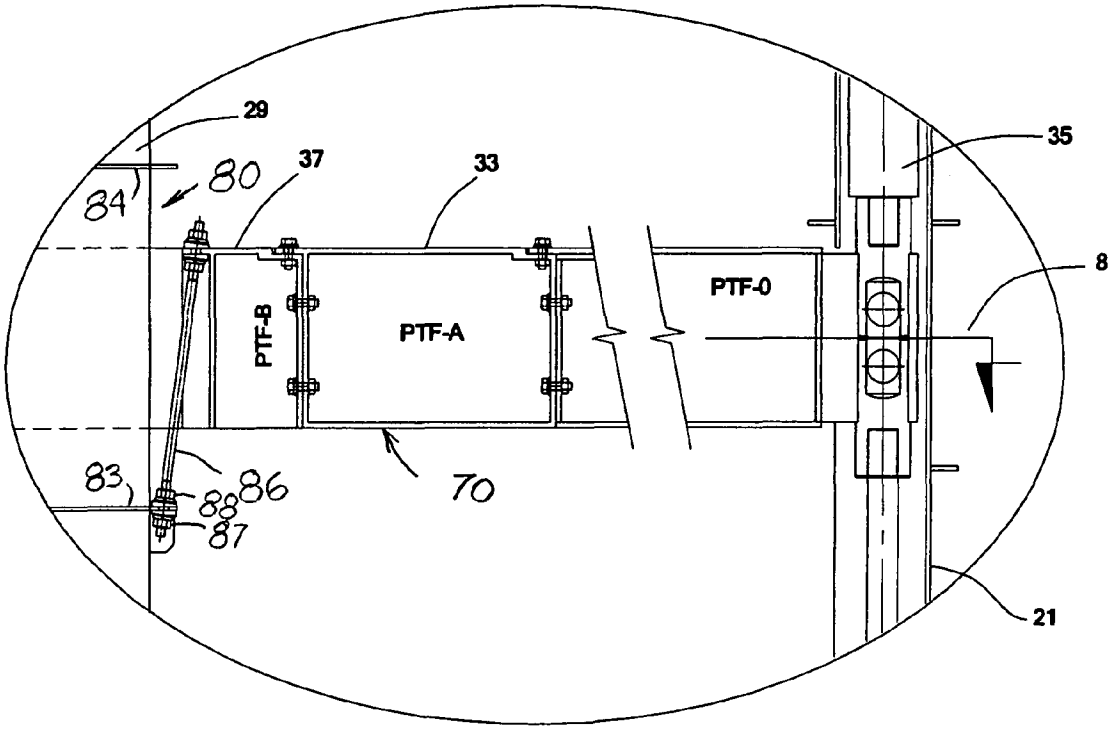
FIG. 7 is a schematic elevational detail of the jack, double acting cylinder, cantilevered arm and ring connector taken along line 7 of FIG. 6.

As shown in the detail of FIG. 7 taken along line 7 of FIG. 6, jacks 30 have cantilevered beams 33 connected to double acting hydraulic cylinders 35 to raise and lower the connected ring sections in the stack assembly 29. The double acting cylinders are supported in the columns 21 of the machine 20. Connectors 37 on ends of beams 33 reciprocate horizontally into contact with the ring sections to lift and lower the stack or out of contact with the ring sections to vertically reposition the beams 33, structures 31 and connectors 37 lower on the stack 29 of assembled ring sections.

Figure 9:
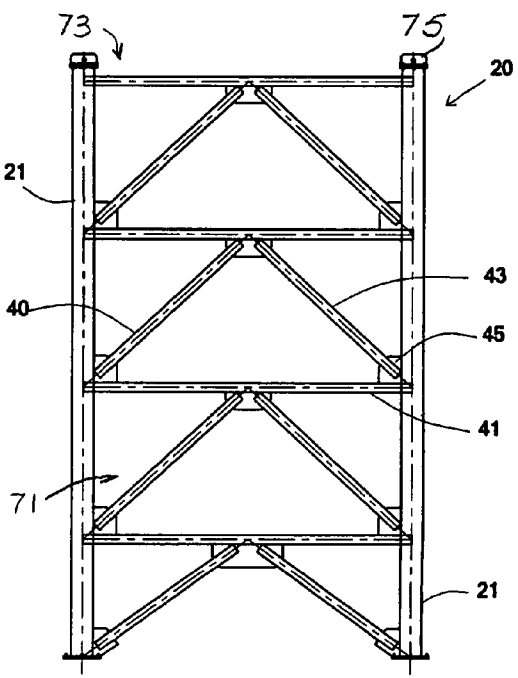
FIG. 9 is a schematic elevation of one other side of the chimney erection machine showing trusses.
Figure 8:
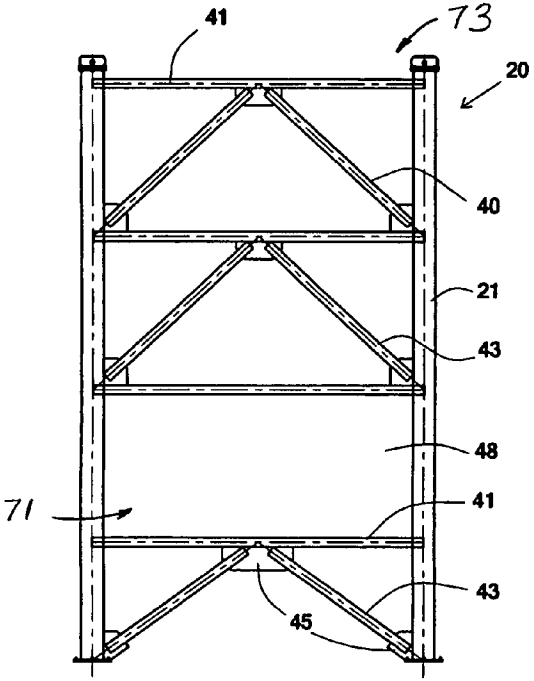
FIG. 8 is a schematic elevation of one side of the chimney erection machine showing trusses and an opening for sequentially inserting completed rings.

The chimney construction machine 20 includes a tower 50 shown in FIGS. 8 and 9 with a mobile platform 70 shown in FIG. 7 that is driven and stabilized by eight hydraulic jacks or cylinders 30 located within the four columns or pillars 21 of this tower.

FIGS. 8 and 9 show trusses 40 which connect the columns 21 in machine 20. The trusses include horizontal members 41 and angular members 43 which are interconnected with gussets 45 to each other and to the columns 21 to form rigid triangular trusses.

As shown in FIG. 8, the angular members 43 and gussets 45 are not present on one side 47 forming an opening 48 near the bottom 49 of the machine 20 to allow laterally inserting of preconstructed ring sections.

There are two working areas 71, 73 in machine 20. One working area 71 is at 16' high, where the sections of the smokestack are welded. The other working area 73 has a 33'×33' platform which is mounted near the top 75 of the tower, where insulation is installed, a ring of special stainless steel profile covering is secured on each flange. The covering is set with pop rivets. The covering plates and the rest of the elements such as platforms, ladders, wind screws and others are connected to the smokestack at the upper platform.

The smokestacks are built in a workshop, in section 8' high, with the exception of the top part of ro. As shown in FIG. 7, each section has two 4"×½" flanges 83, 84, both at 24" from each end, meeting a structural function, supporting the isolation, supporting the stainless coating plate, and to insert the lifting bolts and the attachment bolts. All the lower flanges of each section have 1¼" perforations with a gusset per side. Each flange on sections of 11'6" diameter has 24 holes. On the 20' diameter sections each flange has 48 holes.

Figure 12:
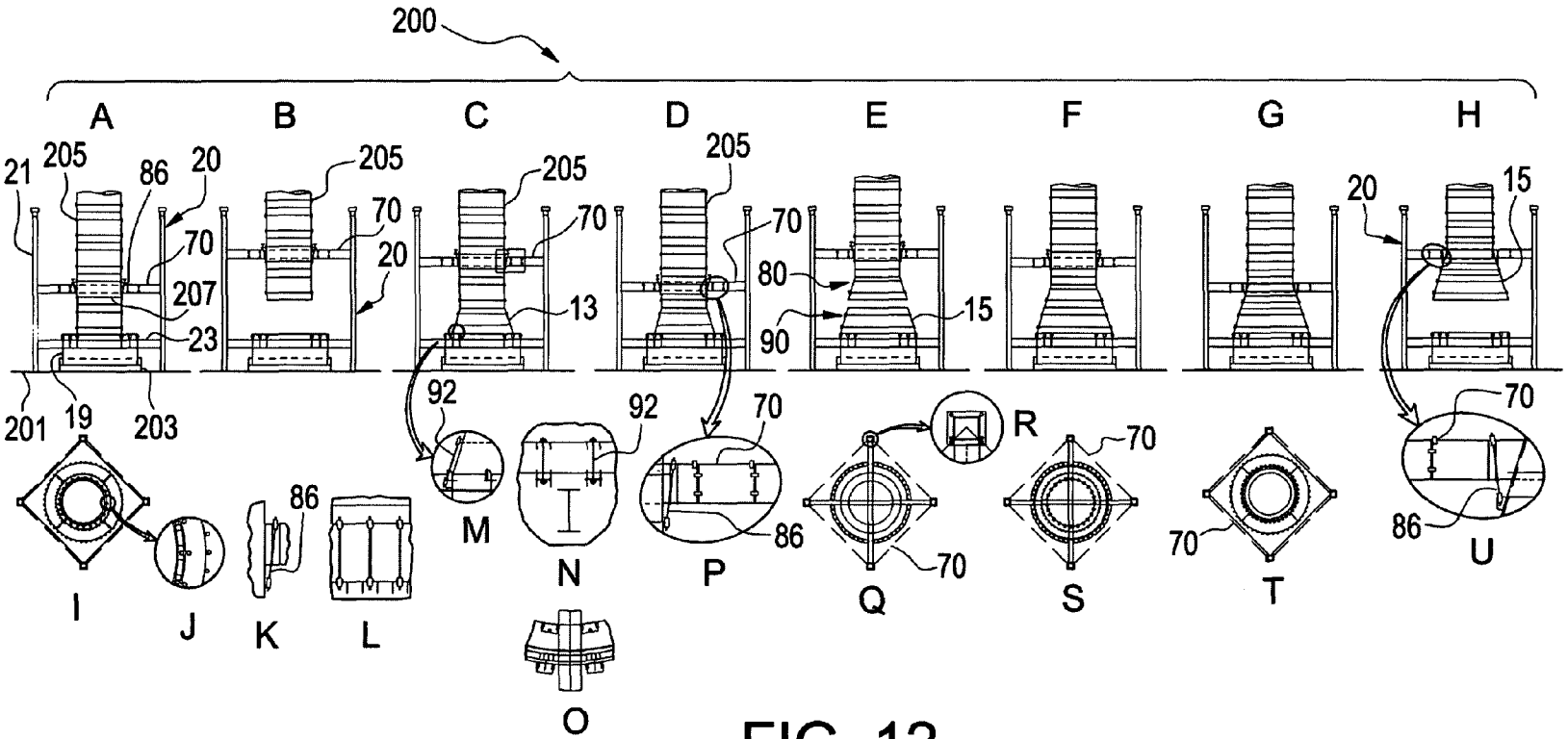
FIG. 12 is a sequential schematic representation of the building sequence with explanatory cross sections and details.

The part or section 80 of the chimney already assembled, is fixed to the mobile platform 70 with rising bolts 86 shown in FIG. 7 that are inserted into the holes 81 of the lower flange 83 and into holes 85 of the mobile platform 70. These bolts carry two securing nuts 87, 88 on each end so as to be able to withstand tension and compression. The torque applied to the securing nuts should be even. The assembled part 80 is lifted to insert a new section 90 (FIG. 12). This new section is fixed to the bottom flange 83 of section 80 by means of holding bolts 92, the upper part 80 is pulled down and welded to the new section 90, the holding bolts 92 are removed. The rising bolts 86 are removed; the mobile platform is lowered, and the rising bolts 86 are reinstalled in a lower flange in the connected sections, the attachment bolts 92 are withdrawn and then the section 90 is lifted again in order to insert another new section.

The smokestack assembly is made by installing 25' of the top part of the stack upon the lower segment, already bolted to the base; then by means of a chimney construction machine, this top part would be raised so as to insert a section of 8' high and be welded to the upper part. This maneuver would be repeated until getting the total height.

The chimney construction machine is based on a platform, which is capable of moving in the direction perpendicular to its plane. The new position is always parallel to the previous one, even although the platform is subjected to a very high momentum of up to 10,000,000 pound feet, for this application.

Figure 10:
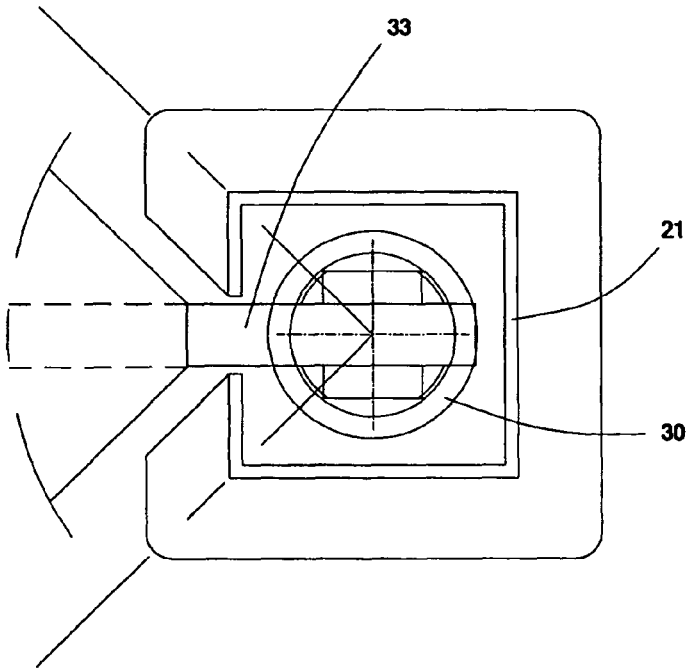
FIG. 10 is a cross section taken along line 8, FIG. 7.

FIG. 10 is a cross section taken along line 8, FIG. 7. The same structure may be used to construct tall thin towers.

Figure 11:
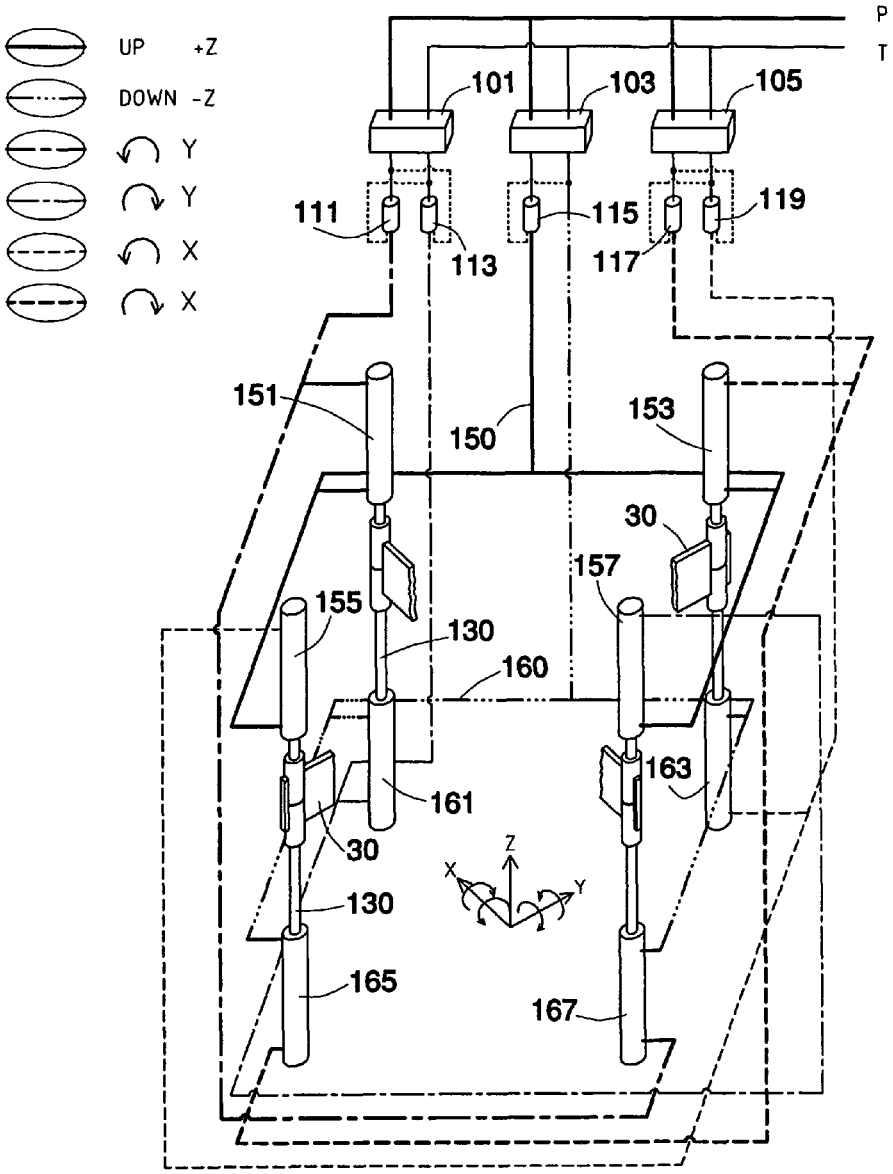
FIG. 11 is a schematic representation of the lifting and lowering hydraulic cylinders, their pistons, the lifting and lowering arms, valves and equalizer connections lines with coded flows for moving the movable platform.

FIG. 11 is a schematic representation of the lifting and lowering hydraulic cylinders, with equalizing chamber, their pistons, the lifting and lowering arms, valves and equalizer connection lines with coded flows for moving the movable platform.

In FIG. 11 pressure source P and tank T are connected to valves 101, 103, 105, which are three way valves. Lines 100 from the valves 101, 103 and 105 and pilot valves 111, 113, 115, 117, 119 connect cylinder chambers to the pressure source P or tank T.

Solid line 150 connects the valve 103 to lower chambers of cylinders 151, 153, 155, 157 to lift the jacks 30 connected to piston rods 130.

Triple dashed line 160 connects valve 103 to the top chambers of cylinders 161, 163, 165, 167 to lower the piston rods 130 and jacks 30.

The other lines act as ends of cylinders act as equalizers as described in U.S. Pat. No. 7,269,949, when valves 101 and 105 are closed (in neutral position) or to lift the platform when valves 101 and 105 are moved.

The basic principle shown and described with respect to FIG. 11 is drawn in FIGS. 9 and 11 of my Synchronizing Hydraulic Cylinders U.S. Pat. No. 7,269,949 B1, published in the U.S. on Sep. 18, 2007, which is incorporated herein by reference, and is based on that a rigid square platform will continue to move in the perpendicular direction parallel to the plane, using two dual action hydraulic cylinders in every corner, opposing each other. This smokestack construction machine has a total of 16 chambers; four drive up; four down, and the eight remaining chambers are connected in a diagonal and opposite manner, and are equalizing chambers. The equalizing chambers generate a momentum opposed to any attempt to take advantage of parallelism in the system, because one will act as a hydraulic pump and the other one, diagonally opposite, would come up as a piston.

FIG. 12 is a sequential schematic representation of the building sequence with explanatory cross sections and details.

From left to right the upper drawings A-H show sequences 200 of the smokestack assembly.

The lower drawings I-U show cross sections and details of the upper drawings. In A a pad 201 is constructed, and a chimney base pad 203 is constructed on pad 201, and a base ring section 19, as shown in FIG. 1, is placed on the pad 201. A chimney construction machine 20 is mounted on pad 201. Heavy beams 23 are connected between pillars 21. A mobile platform 70 is connected to cylinders jacks 30 located within the pillars 21. A 40' upper part 205 is lowered into place on the beams 23. Lifting or rising bolts 86 are connected between a middle flange 207 on the upper part 205 and the mobile platform 70.

As shown in step B, the upper part 205 is raised by the construction machine 20 and the mobile platform 70.

In step C, an upper transition section 13 is inserted in the machine below upper stack part 205. Then the platform 70 is slightly lowered to lower the upper part 205 into contact with the upper transition section 13. Holding bolts 92 and nuts are connected between the bottom flange 209 on upper part 205 and the upper flange 213 of the upper transition 13, followed by welding the parts together and removing the holding bolts 92 and the rising or lifting bolts 86.

In step D, the mobile platform is lowered and the lifting bolts reinstalled in a lower flange 211 of the upper part 205.

In step E, the mobile platform 70 and the upper part 205 and upper transition section 13 are raised. Lower transition part 15 is inserted laterally.

In step F, the mobile platform 70 is slightly lowered to bring the lower edge of the upper transition part 13 into contact with the upper edge of the lower transition part 15. Holding bolts 92 are connected between the lower flange of part 13 and the upper flange of part 15. The edges are welded and holding bolts 92 are removed followed by removing the lifting bolts 86.

In step G, the mobile platform 70 is lowered, and lifting bolts 85 are reinstalled between the mobile platform and the upper flange of upper transition part 13.

In step H, the platform 70 and both connected transition parts 13 and 15 are raised ready to receive a full annular chimney section 16. Section 16 is joined to transition section 15 before adding another annular section 17 and lifting the connected sections, as shown in FIG. 1.

The bolting, lifting, inserting, lowering, bolting, welding, unbolting, platform lowering bolt reinstalling and lifting steps are repeated until the final section is inserted, bolted to the base section and welded. The last holding bolts are removed, the machine 20 is disassembled and removed from the pad 201, and the smokestack is ready for use.

The cross sections and details I-U show the platform 70 in A bolted to a flange 209 in the upper section in I. J shows a plan detail of the flange-platform lifting bolting. K shows an elevational detail of the lifting bolting. L shows an elevational detail of the lifting bolting holding bolts 92. M and N show details holding bolts 92 connecting the upper transitional section to the beams. O shows a top plan detail of M and N. P shows an elevational detail of a lifting bolt connecting a flange on the top part to the mobile platform. Q-S show details of the cross beam connections. T is a plan view of mobile platform 70, and U is an elevational detail of a lifting bolt 86 connected to a transitional section flange and to the mobile platform.

While the invention has been described with reference to specific embodiments, modifications and variations of the invention may be constructed without departing from the scope of this invention.

I claim:

1. A smokestack erection method comprising:

constructing a foundation of reinforced concrete, constructing a base ring section, securing the base ring section to the foundation, constructing a construction machine on the foundation, providing plural vertical double acting hydraulic cylinders in the construction machine, providing a vertically movable platform connected to the hydraulic cylinders, providing lifting bolts extending inward from the platform for connecting to upper sections of the smokestack, providing a support in the machine on the base ring section to support upper rings, constructing a first top section, inserting, positioning and holding the first top section on the base ring section in the construction machine, connecting the first top section to the platform, raising the first top section with the platform and the hydraulic cylinders, holding the first top section upward with the movable platform and the hydraulic cylinders, constructing a second next upper ring section, inserting, positioning and holding the second next upper ring section on the base ring section in the construction machine, juxtaposing the second next upper ring section and the first top section with the platform and the hydraulic cylinders by lowering the platform, connecting the first top section and the second next upper ring section, disconnecting the first to section from the platform, lowering the platform and connecting the platform to the second next upper ring section, lifting the first and second ring sections with the platform and the hydraulic cylinders, holding the first and second ring sections upward, constructing a third upper ring section, inserting, positioning and holding the third upper ring section on base ring section in the construction machine below the second upper ring section, juxtaposing the third upper ring section and the second upper ring section by lowering the platform, connecting the third and second upper ring sections, disconnecting the second upper ring section from the platform, lowering the platform and connecting the platform to the third next upper ring section, lifting the third, second and first upper ring sections with the hydraulic cylinders, holding the third, second and first ring sections elevated, continuing the constructing, inserting, juxtaposing, connecting, disconnecting, lowering, connecting, lifting, and holding subsequent sequential ring sections and an $n^{th}$ ring section and, removing the support, lowering the $n^{th}$ and above ring sections and connecting the nth ring section to the base ring section, removing the construction machine and the hydraulic cylinders and readying the smokestack for use.

2. The method of claim 1, further comprising disassembling and removing the support before juxtaposing the nth ring section and the base ring section.

3. The method of claim 1, wherein the placing the ring sections in the construction machine comprises laterally sliding successive ring sections on rails connected or aligned with the support.

4. The method of claim 1, wherein juxtaposing the upper ring sections comprises raising an inserted subsequent ring section to the next above ring section.

5. The method of claim 1, wherein the support further comprises I beams.

6. The method of claim 1, wherein the connecting comprises bolting.

7. The method of claim 1, wherein the connecting comprises welding.

8. The method of claim 1, wherein the construction machine has a square planform, and the plural hydraulic cylinders comprise four pairs of double acting hydraulic cylinders.

9. The method of claim 1, wherein the lifting framework is about 10 meters high and about 7×7 meters in planform, the smokestack has a 6 meter diameter, the ring sections are about 2.44 meters high and the lifting is about 2.5 meters.

10. A smokestack made according to the method of claim 1 having a height of about 80 meters or more and a base diameter of about 6 meters.

11. The method of claim 1, wherein the plural hydraulic cylinders comprise four vertical pillars arranged in a square platform, wherein the plural cylinders comprise four vertical pairs of double acting hydraulic cylinders, and each of the pairs further comprising interconnected piston rods between upper and lower double acting hydraulic cylinders, and wherein the movable platform is connected to the interconnected piston rods.

12. The method of claim 11, wherein lower ends of upper cylinders are interconnected with hydraulic lines to a hydraulic pressure source for raising the platform and upper ends of upper cylinders are connected with hydraulic lines to lower ends of diagonally opposite lower cylinders for maintaining the smokestack in a vertical position as the smokestack is erected.

13. A smokestack assembly apparatus, the smokestack comprising stacked annular sections, the apparatus comprising:

a construction pad, a base pad extending from the construction pad, a base section mounted on the base pad, a construction machine having plural pillars extending upward from the construction pad having a height less than five stacked annular sections, four pairs of double acting hydraulic cylinders are within the pillars that drive in both the up and down directions, a mobile horizontal platform movable vertically by the hydraulic cylinders, lifting bolts connected to the mobile platform and extending inward therefrom for connecting to a flange on annular sections for sequentially lifting connected sections with the mobile platform while sequentially laterally inserting annular sections along rails in the construction machine, bolts connected to flanges on the annular sections for holding adjacent sections together while welding adjacent sections.

14. The apparatus of claim 13, wherein the four pairs of double acting hydraulic cylinders are interconnected hydraulic cylinders for concurrently lifting connected sections while equalizing movement of all parts of the mobile platform.

15. The apparatus of claim 13, wherein the mobile platform has a central opening for receiving joined sections.

16. The apparatus of claim 13, wherein the construction machine has a lower work area where the sections of the smokestack are welded.

17. The apparatus of claim 13, wherein the construction machine has an upper work area for sequentially covering joined sections, and for attaching ladders and other equipment to the joined sections.

18. The apparatus of claim 13, wherein the four pairs of double acting hydraulic cylinders comprise four vertical pairs of double acting hydraulic cylinders, and each of the pairs further comprising interconnected piston rods between upper and lower double acting hydraulic cylinders, and wherein the movable platform is connected to the interconnected piston rods.

19. The apparatus of claim 18, wherein lower ends of upper cylinders are interconnected with hydraulic lines to a hydraulic pressure source for raising the platform, and upper ends of upper cylinders are connected with hydraulic lines to lower ends of diagonally opposite lower cylinders for maintaining the smokestack in a vertical position as the smokestack is assembled.

* * * * *